United States Patent [19]

Dakin

[11] Patent Number: 4,605,881

[45] Date of Patent: Aug. 12, 1986

[54] HIGH PRESSURE SODIUM IODIDE ARC LAMP WITH EXCESS IODINE

[75] Inventor: James T. Dakin, Schenectady, N.Y.

[73] Assignee: General Electric Company, Schenectady, N.Y.

[21] Appl. No.: 676,349

[22] Filed: Nov. 29, 1984

[51] Int. Cl.[4] ..... H01J 17/20; H01J 61/18

[52] U.S. Cl. ..... 313/638; 313/639

[58] Field of Search ..... 313/638, 639, 642, 571, 313/116

[56] References Cited

U.S. PATENT DOCUMENTS

| | | | |
|---|---|---|---|
| 3,234,421 | 2/1966 | Reiling | 313/25 |
| 3,351,798 | 11/1967 | Bauer | 313/571 |
| 3,398,312 | 8/1968 | Edris et al. | 313/642 |
| 3,911,308 | 10/1975 | Akutsu et al. | 313/184 |
| 3,979,624 | 9/1976 | Lui et al. | 313/639 |
| 4,171,498 | 10/1979 | Fromm et al. | 313/116 |

FOREIGN PATENT DOCUMENTS

| | | | |
|---|---|---|---|
| 1463568 | 12/1966 | France | 313/638 |

OTHER PUBLICATIONS

U.S. Patent Application Ser. No. 454,225, of P. D. Johnson, Filed Dec. 29, 1982, which is basis for English patent application 2133925A published Aug. 1, 1984.

*Primary Examiner*—Davis L. Willis
*Assistant Examiner*—William L. Oen
*Attorney, Agent, or Firm*—Marvin Snyder; James C. Davis, Jr.

[57] ABSTRACT

Iodine in excess of sodium-iodide stoichiometry is used in the fill for a sodium iodide arc lamp which also includes sodium iodide and xenon buffer gas. The presence of free sodium near the arc tube walls is eliminated and efficacy is improved.

7 Claims, 1 Drawing Figure

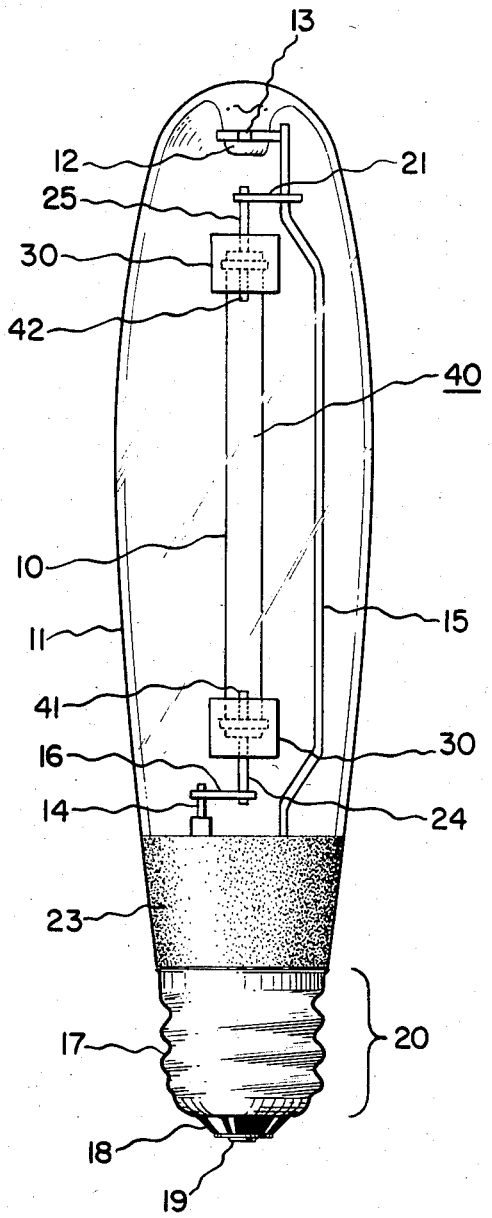
13
12
21
25
30
42
40
10
15
11
41
30
16
14
24
23
20
17
18
19

HIGH PRESSURE SODIUM IODIDE ARC LAMP WITH EXCESS IODINE

The present invention relates in general to high efficacy high pressure sodium iodide arc discharge lamps and more specifically to the use of excess iodine in a sodium iodide arc discharge lamp.

BACKGROUND OF THE INVENTION

In high intensity arc discharge lamps, the radiated light output is derived from a plasma arc discharge within an arc tube. One form of high intensity discharge lamp that is currently and conventionally employed is the sodium iodide lamp. In such lamps the arc discharge tube includes sodium iodide which is vaporized and dissociated in the plasma arc during lamp operation. However, in the vicinity of the arc tube walls, where the temperature is cooler, sodium remains chemically bound to the iodine limiting the presence of free sodium which absorbs some of the light radiation from the arc discharge.

The self-absorption characteristics of cooler sodium atoms distributed preferentially near the cooler arc tube walls act to limit lamp efficacy. In particular, sodium D-line radiation produced within the hot central plasma region of the arc tube would be readily absorbed by the cooler sodium atoms which would be present near the arc tube walls.

While the use of sodium iodide in the lamp lessens the presence of free sodium near the cooler arc tube walls, the sodium to iodine ratio in this area remains greater than unity. With its smaller atomic mass, sodium diffuses to the arc tube walls more rapidly than iodine. Thus, lamp efficacy is still limited by the presence of free sodium near the arc tube walls.

The high pressure sodium iodide arc lamp requires the use of a buffer gas to limit the transport of energy from the arc discharge to the arc tube walls via chemical reaction. Mercury is conventionally employed as the buffer gas at a high pressure. However, high pressure mercury broadens the sodium D-line radiation toward the red and can tie-up iodine by forming mercury iodide, resulting in more free sodium near the arc tube walls. Copending application Serial No. (676,367), assigned to the assignee of the present invention, discloses xenon buffer gas for improving the efficacy of the high pressure sodium iodide arc lamp. However, even with xenon as the buffer gas, the sodium to iodine ratio in the vicinity of the arc tube walls remains greater than unity (i.e. some free sodium remains) during lamp operation.

OBJECTS OF THE INVENTION

It is a principal object of the present invention to eliminate free sodium near the arc tube walls of high pressure sodium iodide arc discharge lamps.

It is another object of the present invention to improve the efficacy of high pressure sodium iodide arc discharge lamps with xenon buffer gas.

SUMMARY OF THE INVENTION

These and other objects are achieved in a high pressure sodium iodide arc lamp having an arc tube for containing an arc discharge by utilizing an arc tube fill comprising sodium iodide, xenon buffer gas and iodine in sufficient quantity to reduce the partial pressure of sodium at the arc tube walls to zero during lamp operation. The amount of sodium iodide in the lamp provides a sodium pressure in the arc discharge of about 10 to about 100 torr. The excess iodine is provided in an amount which would provide an iodine partial pressure of about 10 to 50 torr in excess of overall sodium-iodine stoichiometry when the lamp is in operation. The iodine in the lamp may be derived from mercury iodide added to the fill.

The present invention further contemplates a high intensity metal halide arc discharge lamp comprising an outer light transmissive envelope, a light transmissive arc discharge tube with electrodes at opposite ends of the arc tube and means to provide electrical connections to the electrodes. A vaporizable discharge medium is disposed within the arc tube, and includes sodium iodide together with xenon buffer gas and an excess of iodine.

The features and advantages of the present invention will become apparent from the following detailed description of the invention when read with the accompanying drawing.

BRIEF DESCRIPTION OF THE DRAWING

The sole drawing FIGURE is a side elevation view of a typical high pressure sodium iodide arc lamp in which the present invention may be embodied.

DETAILED DESCRIPTION OF THE INVENTION

The FIGURE shows a high intensity arc discharge lamp comprising an outer light transmissive envelope 11. This outer envelope preferably comprises a material such as heat resistant glass or silica. The lamp also comprises a light transmissive arc discharge tube 10 which has electrodes disposed internally at opposite ends thereof. Arc discharge tube 10 is typically configured in a cylindrical shape and must be resistant to attack by the materials employed in a gaseous discharge medium 40 contained within the arc tube. In particular, arc discharge tube 10 preferably comprises a refractory ceramic material such as sintered polycrystalline alumina, or may comprise fused quartz. Arc discharge tube 10 may have an internal diameter of about 5 to 20 millimeters and an arc gap of 50 to 150 millimeters, for example. The volume between arc discharge tube 20 and outer envelope 11 is generally evacuated to prevent efficacy robbing heat losses from arc tube 10. Getter material 23 may be disposed on the interior of outer envelope 11 to assist in maintaining vacuum conditions in the volume between arc tube 10 and outer envelope 11.

Structures are shown in the Figure for providing electrical connection and support for arc tube 10. In particular, supporting wire conductors 14 and 15 provide part of a means for connecting the arc tube electrodes 41 and 42 to external connections. Supporting wire conductor 15 extends upward through the vacuum region of the lamp and is preferably welded to a hexagonal bracing washer or ring 13 which is disposed about a dimple 12 provided in the end of an outer envelope 11 to furnish support for arc discharge tube 10. Lateral support wire 21 is preferably spot welded to an arc tube termination lead 25 and to supporting wire conductor 15. Similarly, at the base end of the lamp shown in the Figure, a lateral support 16 is spot welded to supporting wire conductor 14 and a lower arc tube termination 24 so as not only to support arc tube 10 but also to supply electrical current to the electrodes therein. Thus, current through the gaseous discharge medium 40 typically follows a path defined by the following components: supporting wire conductor 14, lower lateral support 16, lower arc tube termination 24, the lower electrode 41 in arc tube 10, gaseous discharge medium 40, the upper electrode 42 in arc tube 10, upper arc tube termination 25, lateral support wire 21, and supporting wire conductor 15. Supporting wire conductors 14 and 15 are separately connected to either of external screw base connection 17 or center exterior contact 19 on edison base 20. Insulating material 18 separates base connection 17 and exterior contact 19.

The lamp shown in the Figure further includes heat shields 30 disposed about the ends of arc tube 10. These heat conserving end shields made of heat insulating material to minimize heat radiation from the ends of arc tube 10, are employed because metal halide lamps require a high temperature to maintain desired vapor pressure of the radiating metal of the lamp fill.

Gaseous discharge medium or fill 40 comprises sodium iodide, xenon buffer gas and an excess of iodine. The amount of sodium iodide in fill 40 will provide a sodium pressure within an arc discharge during lamp operation of about 10 to about 100 torr. Xenon buffer gas is present at a partial pressure of about 100 to about 500 torr at room temperature.

During lamp operation, the vaporized species of fill 40 will adjust their local concentrations so as to provide local thermodynamic equilibrium while balancing diffusion fluxes resulting from concentration gradients. Assuming that the diffusion coefficients of sodium, iodine and sodium iodide in xenon, relative to that of sodium iodide, are 2.53,1.56, and 1.0, respectively, and assuming equal amounts of sodium and iodine in the vapor phase (i.e. no excess iodine added), the free sodium partial pressure at the arc tube walls during lamp operation will be substantially above zero and the iodine partial pressure at the arc tube walls will be essentially zero. For example, in a lamp with sodium and iodine at sodium-iodine stoichiometry (i.e. all sodium and iodine combined at room temperature), having an arc center temperature of about 4500° K. and an arc tube wall temperature of about 1500° K., and a sodium pressure at the center of the arc of about 52 torr, the free sodium partial pressure at the arc tube walls is about 13 torr and iodine partial pressure at the arc tube walls is zero.

In order to reduce the sodium partial pressure at the arc tube walls to near zero, excess iodine is included in fill 40 at an amount sufficient to provide an iodine partial pressure which is 10 to 50 torr in excess of overall sodium-iodine stoichiometry when the lamp is in operation.

In the present invention, the excess iodine in fill 40 may be derived from mercury iodide added to fill 40. The iodine in the mercury iodide will preferentially combine with free sodium near the arc tube walls during operation of the lamp. The limited amount of mercury added to fill 40 results in a mercury partial pressure too small to cause the problems discussed previously.

The foregoing describes a high pressure sodium iodide arc lamp and fill for such lamp wherein iodine in excess of sodium iodide stoichiometry is added in order to eliminate the presence of free sodium near the arc tube walls during operation of the lamp. The efficacy of the lamp is improved since radiation from the arc discharge is no longer absorbed by free sodium near the arc tube walls.

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

What is claimed is:

1. In a high pressure sodium iodide arc lamp having an arc tube for containing an arc discharge, an arc tube fill comprising sodium iodide;

xenon buffer gas in an amount providing a xenon partial pressure in the range of about 100 torr and higher at room temperature; and iodine in sufficient quantity to reduce, the partial pressure of sodium at the walls of said arc tube to substantially zero during operation of said lamp.

2. The lamp of claim 1 wherein said sodium iodide is present in sufficient quantity to provide a sodium pressure during operation of said lamp in said arc discharge of about 10 to about 100 torr.

3. The lamp of claim 2 wherein said quantity of iodine equals an amount which provides an iodine partial pressure of 10 to 50 torr in excess of overall sodium-iodine stoichiometry in the presence of an arc within said arc tube.

4. The lamp of claim 1 wherein said iodine is derived from mercury iodide included in said fill.

5. A high intensity arc discharge lamp comprising:

an outer light transmissive envelope;

a light transmissive arc discharge tube situated within said envelope and having electrodes at opposite ends thereof;

means to provide electrical connection to said electrodes;

sodium iodide disposed within said arc tube;

xenon buffer gas disposed within said arc tube in an amount providing a xenon partial pressure in the range of about 100 torr and higher at room temperature; and iodine disposed within said arc tube in a sufficient quantity to reduce the partial pressure of sodium at the walls of said arc tube to substantially zero during operation of said lamp.

6. The lamp of claim 5 wherein said sodium iodide is present in sufficient quantity to provide a sodium pressure during operation of said lamp in said arc discharge of about 10 to about 100 torr.

7. The lamp of claim 6 wherein said quantity of iodine equals an amount which provides an iodine partial pressure of about 10 to 50 torr in excess of overall sodium-iodine stoichiometry in the presence of an arc within said arc tube.

* * * * *